United States Patent [19]

Nomura et al.

[11] 4,181,107

[45] Jan. 1, 1980

[54] CARBURETOR CHOKE VALVE CONTROLLING DEVICE

[75] Inventors: Toshio Nomura, Niiza; Toshimasa Shishido, Tokyo, both of Japan

[73] Assignee: Honda Giken Kogyo Kabushiki Kaisha, Tokyo, Japan

[21] Appl. No.: 871,645

[22] Filed: Jan. 23, 1978

Related U.S. Application Data

[63] Continuation of Ser. No. 640,795, Dec. 15, 1975, abandoned, which is a continuation of Ser. No. 503,982, Sep. 6, 1974, abandoned.

[30] Foreign Application Priority Data

Sep. 7, 1973 [JP] Japan ..... 48-100282

[51] Int. Cl.[2] ..... F02M 1/12

[52] U.S. Cl. ..... 123/119 F; 261/39 A; 261/39 B

[58] Field of Search ..... 123/119 F; 261/39 A, 261/39 B

[56] References Cited

U.S. PATENT DOCUMENTS

| | | | |
|---|---|---|---|
| 2,262,408 | 11/1941 | Read | 261/39 B |
| 2,336,810 | 12/1943 | Smith | 123/119 F |
| 2,394,665 | 2/1946 | Christian | 261/39 B |
| 2,810,559 | 10/1957 | Winkler | 261/39 A |
| 2,943,848 | 7/1960 | Gordon et al. | 261/39 B |
| 2,946,577 | 7/1960 | Dennison et al. | 261/39 B |
| 2,969,783 | 1/1961 | Braun | 123/119 F |
| 2,970,825 | 2/1961 | Smitley | 261/39 B |
| 3,159,692 | 12/1964 | Kittler | 123/119 F |
| 3,185,453 | 5/1965 | Mennesson | 123/119 F |
| 3,248,675 | 4/1966 | Furbacher | 261/39 B |
| 3,291,462 | 12/1966 | Mennesson | 261/39 A |
| 3,699,937 | 10/1972 | DePetris | 123/119 F |
| 3,807,709 | 4/1974 | Suda et al. | 261/52 |
| 3,931,797 | 1/1976 | Yoshida | 123/119 F |
| 3,967,600 | 7/1976 | Iiyama | 123/119 F |

*Primary Examiner*—Charles J. Myhre
*Assistant Examiner*—David D. Reynolds
*Attorney, Agent, or Firm*—Lyon & Lyon

[57] ABSTRACT

A control system for the choke valve of a caburetor employs a bimetal element heated by an electric resistance heater when the engine is running to move the choke valve toward open position. A vacuum actuator is connected to move the choke valve toward open position when manifold vacuum pressure develops upon starting of the engine. Linkage connects the throttle valve to an unloader device which insures that the choke valve is held open when the throttle valve is opened beyond a predetermined limit. A temperature responsive device subjected to a flow of engine coolant or lubricant operates a fast idle device which holds the throttle valve at fast idle position and allows it to return to slow idle position only when the engine coolant or lubricant has been heated to a sufficient extent. The fast idle device is connected through linkage to prevent closing movement of the choke valve in the event that the engine is stopped in hot condition, thereby facilitating re-starting of the engine while hot.

2 Claims, 8 Drawing Figures

CARBURETOR CHOKE VALVE CONTROLLING DEVICE

This is a continuation, of application Ser. No. 640,795 now abandoned filed 12/15/75 which was continuation of Ser. No. 503,982 filed 9/6/74 now abandoned.

This invention relates to carburetors for internal combustion engines and is particularly directed to improved apparatus for controlling the action of the choke valve in such a carburetor. The purpose is to enable the engine to start up smoothly whether cold or hot and to minimize pollutants in the exhaust gases of the engine.

In the past, a bimetal element has been connected to a carburetor choke valve to supply closing torque, depending on the engine ambient temperature. It has also been known to connect the choke valve to a vacuum actuator that operates in response to complete firing of the engine, using as a power source the intake vacuum of the engine. However, with such a system, the mixture produced in the carburetor upon complete firing of the engine tends to be too rich when it is hot and too lean when it is cold. Also, the choke valve closing torque remaining in the bimetal element may remain too high during engine startup conditions so that, until the time that the engine ambient temperature has increased sufficiently to reduce the closing torque, the bimetal element is unable to open the choke valve.

This may be expressed by a chart such as shown in FIG. 8 where the line h' shows an example of the choke valve opening characteristics at normal temperature, and the line j' shows the same at low temperature. The straight portion of these lines indicates the periods in which, despite the rise in engine temperature with time, tilting of the choke valve stays the same, with the mixture produced becoming too rich, thereby increasing the amount of unburned components in the engine exhaust Moreover, with conventional devices, when the engine is stopped after having been warmed up, the temperature of the temperature sensitive means begins to fall to close the choke valve before the engine temperature begins to change, since the heating means ceases to heat the temperature sensitive means immediately after the engine is stopped. Consequently, when the engine is started again, a mixture of excessively high air-fuel ratio is produced in the carburetor, thereby reducing the startability of the engine and increasing the amounts of harmful unburned ingredients contained in the engine exhaust, as well.

This invention eliminates the disadvantages described above and provides apparatus for controlling the choke valve in a manner to produce a choke valve closing torque in proportion to the engine ambient temperature to act on the choke valve, but also to open the choke valve in starting of the engine, after complete firing of the engine, at a choke pulldown angle suited to the engine ambient temperature.

Other and more detailed objects and advantages will appear hereinafter.

Figure 1:
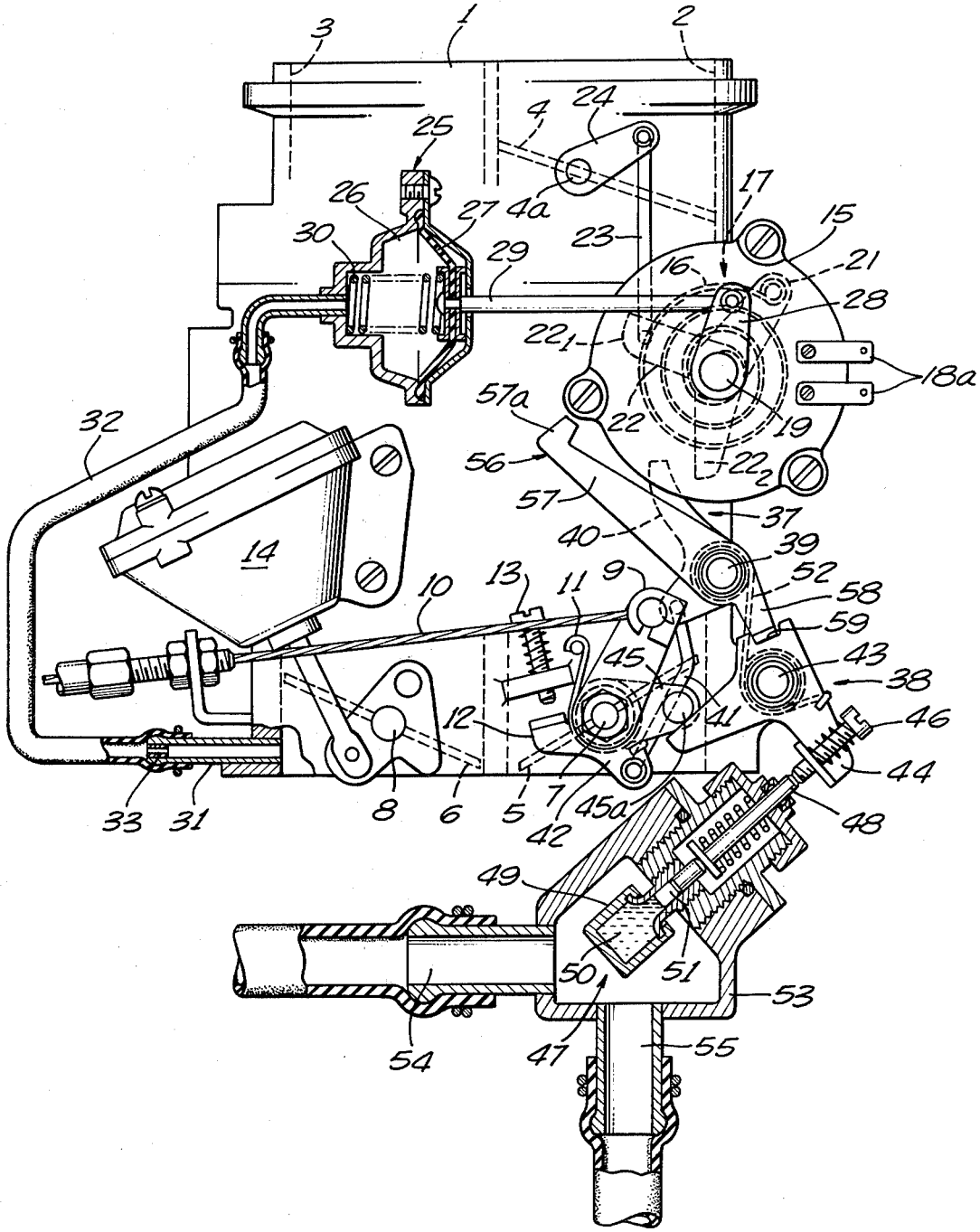
FIG. 1 is a front elevation partly in section showing a preferred embodiment of this invention.
Figure 2:
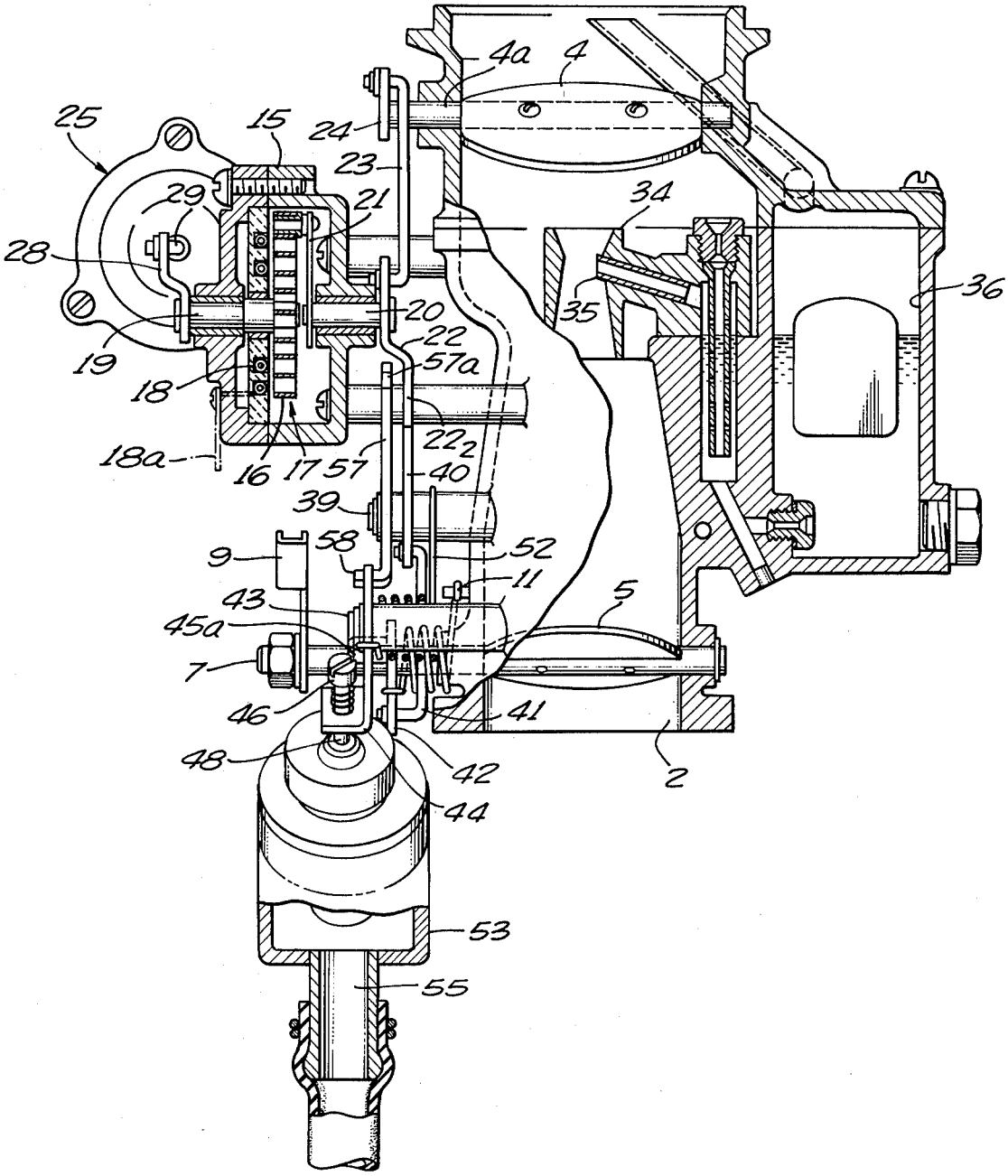
FIG. 2 is a side elevation thereof partly broken away and partly in section.

Referring to the drawings, the compound carburetor 1 is provided with a primary intake passage 2 and a secondary intake passage 3, both of which are connected downstream thereof (toward the lower part of FIG. 1) to an internal combustion engine, not shown. In the upper portion of the primary intake passage 2, a choke valve 4 is mounted eccentrically on a valve shaft **4*a* mounted to the left of a center position, as viewed in FIG. 1, so that intake vacuum of the engine acts on the choke valve 4 to cause it to tend to move in a clockwise direction toward an open position. A primary throttle valve 5 is mounted in the downstream portion of the primary intake passage 2, and a secondary throttle valve 6 is mounted in the downstream portion of the secondary intake passage 3. The throttle valves 5 and 6 turn with their respective valve shafts 7 and 8. The primary throttle valve 5 is opened by an operating cable 10 and closed by the return force of a valve closing spring 11, the operating cable 10 being connected to the throttle valve lever 9 fixed to the valve shaft 7. The idling position is controlled by contact between the main stopper arm 12 fixed to the valve shaft 7 and an idle stopper screw 13 provided on the body of the carburetor 1. The secondary throttle valve 6 is opened by means of the vacuum actuator 14, which moves when vacuum pressure downstream of the throttle valves 5 and 6** reaches a predetermined minimum value.

A first control case 15 is fixed with respect to the carburetor body and contains a first temperature sensitive device 17 comprising a spiral bimetal element 16 and an electric heater 18 formed of nichrome wire. The inside end of the bimetal element 16 is fixed to the shaft 19 supported for turning movement in a side wall of the control case 15. The outside end of the bimetal element 16 is connected to the upper end of a bimetal follower lever 21 mounted on a shaft 20 which is mounted to turn on the other side wall of the control case 15. Also fixed to the shaft 20 on an overhanging end is a bell crank 22 having an arm $22_1$ connected by rod 23 to the choke lever 24 fixed to the choke valve shaft **4*a*. The electric heater 18 which starts to operate from the time when complete firing occurs in the engine, serves to heat the interior of the first control case 15, and the bimetal element 16 has a thermal deformation characteristic capable of giving the choke valve 4 an optimum choke pulldown angle. The terminals 18*a* for the electric heater 18** are connected to a battery, not shown.

A vacuum actuator 25 is fixed in position outside the carburetor 1 at a location adjacent to the first control case 15. A vacuum chamber 26 has one side defined by a flexible diaphragm 27 and this diaphragm 27 is connected through an operating rod 29 to an operating lever 28 attached to the overhanging end of the shaft 19. Within the vacuum chamber 26 is a valve closing spring 30 acting to move the operating lever 28 in a direction to close the choke valve 4. The vacuum chamber 26 is connected through vacuum conduit 32 and pipe 31 communicating with the secondary intake passage downstream from the throttle valve 6. An orifice 33 is provided in the pipe 31 to retard admission of intake vacuum pressure of the engine into the vacuum chamber 26.

Figure 6:
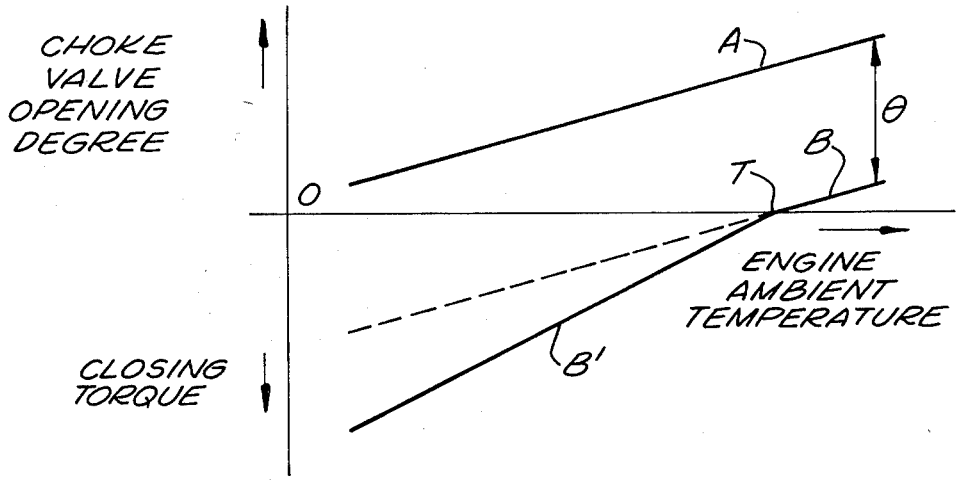
FIG. 6 is a diagram showing engine ambient temperature plotted against choke pulldown angle characteristics and choke valve closing torque characteristics.

The venturi element 34 receives fuel from the main nozzle 35 connected to the float chamber 36. When the engine is not running, the vacuum chamber 26 of the vacuum actuator 25 is maintained internally at atmospheric pressure, so that the operating diaphragm 27 is pushed by the spring 30 toward the right-hand movable limit as shown in FIG. 1, thereby causing the shaft 19 to turn in the direction to close the choke valve 4, and causing the inner end of the bimetal element 16 to turn through a predetermined angle. Tilting of the choke valve 4 is thus changed from an angle on the choke pulldown angle line A in FIG. 6 to an angle smaller by predetermined $\theta$ degrees on the starting choke angle line B. However, when the engine ambient temperature or temperature inside the first control case 15 is below point T, the choke valve 4 has been fully closed before it moves $\theta$ degrees, so that the subsequent force of the valve closing spring 30 is stored in the bimetal element 16 as a choke valve closing torque for the choke valve 4. This closing torque increases with decrease in the engine ambient temperature, as shown by the choke valve closing torque line B' in FIG. 6. Therefore, in this condition, if the engine is cranked by a starting motor under startup conditions, an approximately fixed opening torque caused by intake vacuum of the engine is balanced against closing torque, and the choke valve 4 is maintained at a proper starting position. The rich mixture in the primary intake passage enables the engine to start quickly.

Figure 3:
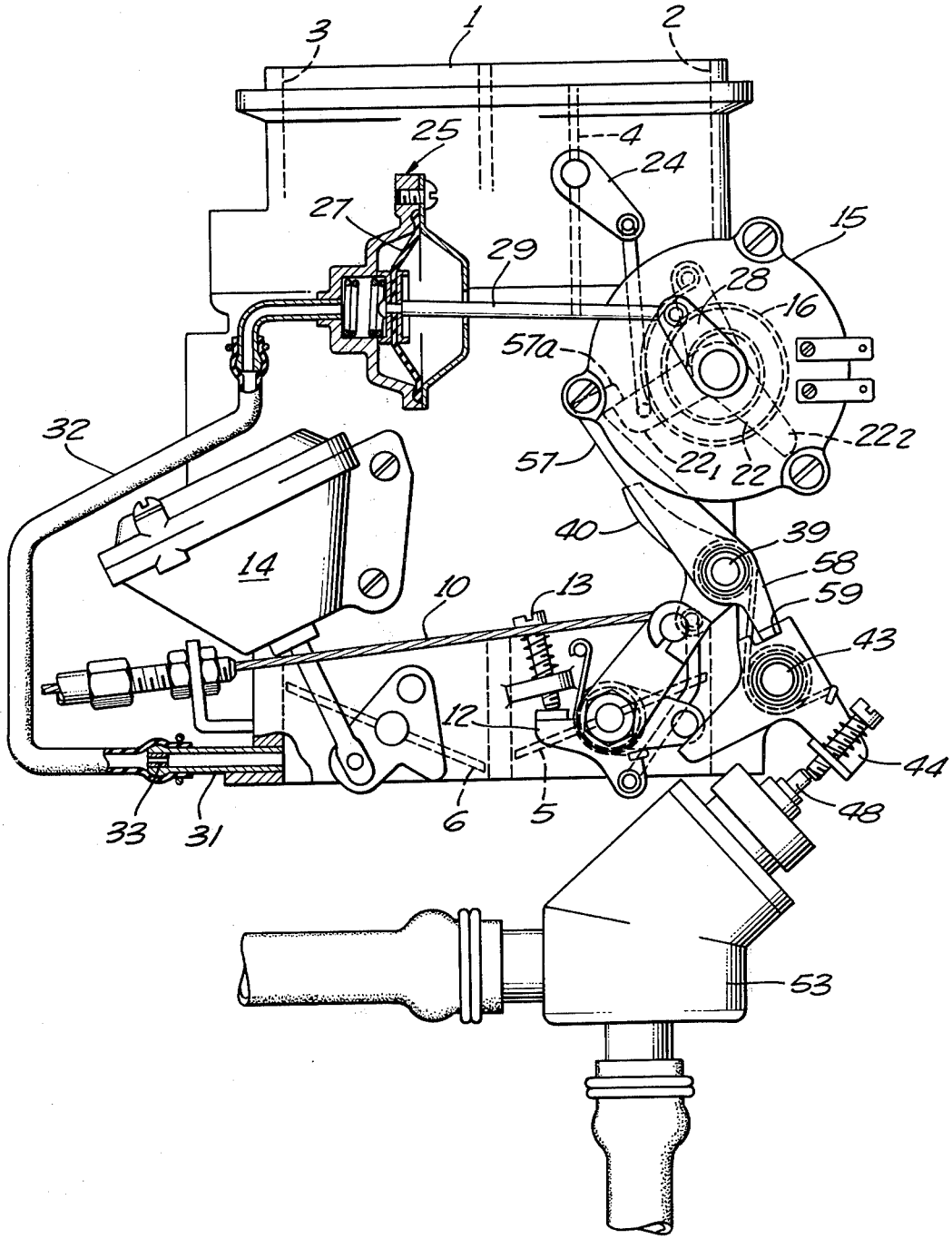
FIG. 3 is a view similar to FIG. 1 with certain parts shown in a different operating position.

After starting, when the engine speed stabilizes to some extent to bring about a state of so-called complete firing, intake vacuum pressure of the engine passes through the orifice 33 in the vacuum pipe 31 to reduce the pressure in the vacuum chamber 26 sufficiently, so that the operating diaphragm 27 moves to the left as shown in FIG. 3 against the force of the valve closing spring 30. The operating lever 28 turns the shaft 19 and the inner end of the bimetal element 16 in the direction to open the choke valve 4. Thus, the choke valve closing torque of the bimetal element 16 is eliminated, and tilting of the choke valve 4 returns to an angle on the choke pulldown angle line A in FIG. 6. Beginning at that time the first control case 15 is heated internally by the electric heater 18 and controlled to a standard engine ambient temperature, and with rise in the temperature the bimetal element 16 deforms immediately, causing the bimetal follower lever 21 to move the choke driving lever 22 in a direction to open the choke valve 4 without delay.

Figure 7:
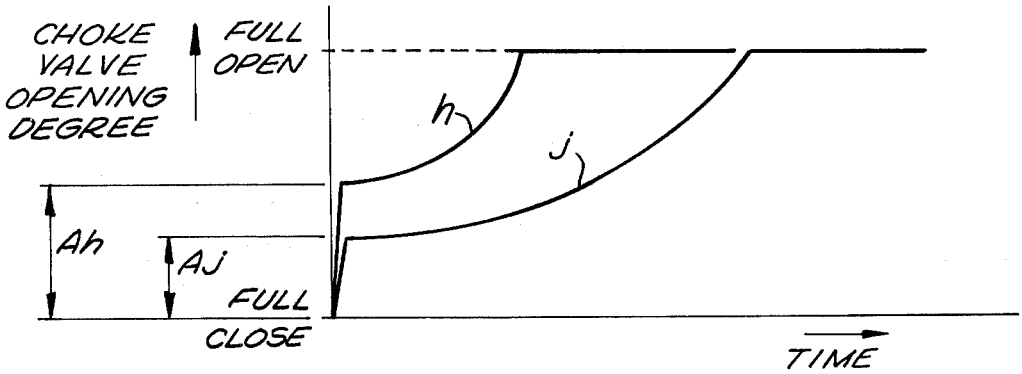
FIG. 7 is a diagram showing opening characteristics of the choke valve of this invention plotted against time.
Figure 8:
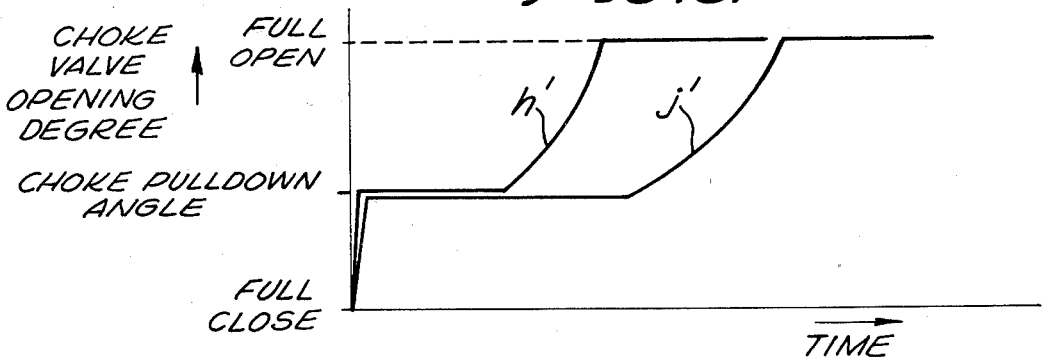
FIG. 8 is a diagram similar to FIG. 7 showing opening characteristics of a conventional choke valve plotted against time.

The opening characteristics of the choke valve 4 are shown in FIG. 7 where the line h represents an example when the engine ambient temperature is normal, and the line j represents an example when it is low. It is clear from FIG. 7 that the choke pulldown angles Ah and Aj differ from each other depending on the engine ambient temperature, and that, after complete firing, tilting of the choke valve 4 in either case is made to increase continuously with a lapse of time or rise in the temperature. Therefore, the rich mixture produced after starting of the engine is at once made leaner with rise in the engine ambient temperature so as to stabilize combustion and to reduce unburned constituents in the exhaust gas.

In the place of the vacuum actuator 25, it is possible to employ an electromagnetic actuator which is designed to operate at the time of complete firing of the engine.

The carburetor 1 is also equipped with an unloader system 37 which, in the wide opening range of the primary throttle valve 5, acts to open the closed choke valve 4. Also, the carburetor is equipped with a fast idling system 38 which, in order to stabilize idling operation in cold weather, automatically adjusts tilting of the primary throttle valve 5 for idling in proportion to the engine temperature. In addition, a choke valve holding system 56 is provided which, in the high temperature range of the engine, holds the choke valve 4 at a fully opened position. These three systems are set forth in detail below.

The unloader system 37 includes a bell crank 40 having a pivotal support 39 positioned between the shaft 7 for the primary throttle valve 5 and the first control case 15. A connecting rod 41 engages one end of the bell crank 40 and connects it to choke driving crank 42 formed integrally with the main stopper arm 12. The other end of the bell crank 40 is positioned to engage the arm $22_2$ of the choke driving lever 22 so that when the operating cable 10 is moved to open the throttle valve 5 beyond a predetermined position, the unloader lever 40 engages the arm $22_2$ to move it in a clockwise direction as viewed in FIG. 1, and thereby to open the choke valve 4. This insures sufficient amount of air for the engine for operating under heavy load even in cold weather.

The fast idling system 38 includes a pivoted lever 44 mounted on a stationary support shaft 43 and having a portion which contacts the cylindrical boss 45*a* on the auxiliary stopper arm 45 which is formed integrally with the main stopper arm 12. An adjustment screw 46 carried by another portion of the fast idling lever 44 contacts the operating rod 48 of a second sensor 47. This second sensor includes a canister 49 having an opening which slidably receives the lower end of the operating rod 48. Wax or other incompressible thermal expanding material 50 is contained within the canister. A sliding packing element 51 is interposed between the operating rod and the thermal expanding material 50. A valve opening spring 52 acts to move the fast idling lever 44 in the direction of opening the primary throttle valve 5, and this spring 52 is stronger than the valve closing spring 11.

The canister 49 is incorporated in a second control case 53 secured in a stationary position with respect to the carburetor 1. This second control case has an entrance 54 and an exit 55 for engine coolant or engine lubricant. The canister 49 and therefore the thermal expanding material 50 are thus maintained at substantially the same temperature as that of the engine coolant or engine lubricant. Thus, when the engine operating temperature is low, the thermal expanding material 50 shrinks to allow the operating rod 48 to move into the canister 49 in proportion to the amount of shrinkage, so that the fast idling lever 44 is turned by torsional force of the valve operating spring 52. One end of the lever 44 drives the auxiliary stopper arm 45 to open the primary throttle valve 5 moderately. As the engine temperature rises, the thermal expanding material 50 expands to push the operating rod 48 against the force of the valve opening spring 52, causing the fast idling lever 44 to move away from the auxiliary stopper arm 45, so that the primary throttle valve 5 is caused to move to idling position by the action of the valve closing spring 11. Thus, tilting of the primary throttle valve 5 for idling is adjusted automatically and steplessly with changes in the engine temperature, and thereby maintain a stable idling operation of the engine.

The choke valve holding system 56 includes a pivoted lever 57 mounted on the support 39 and having a hook 57*a* at the swinging end thereof engageable with the arm $22_1$ of the choke driving lever 22. An arm 58 of the pivoted lever 57 projects into a groove 59 at the base of the fast idling lever 44 so as to make connection with the second sensor 47. Therefore, when the engine temperature rises sufficiently, the expanding material 50 causes the hooked lever 57 to turn clockwise as viewed in FIG. 1 to engage the hook 57*a* with the arm $22_1$ of the choke driving lever 22 which has at that time been holding the choke valve 4 at fully opened position as shown in FIG. 3. Thus, at this moment, even if the engine stops and the temperature inside the first control case 15 lowers immediately because of power shut off to the electric heater 18, so long as the engine operating temperature inside the second control case 53 does not lower, the choke driving lever is restrained by the hooked lever 57 from turning, so that the choke valve 4 continues to be held at a fully open position. In view of the above, in re-starting of the engine while it is still hot, the air-fuel mixture supplied to the engine is not over rich. Starting is facilitated and unburned components in the exhaust gas are minimized.

Figure 4:
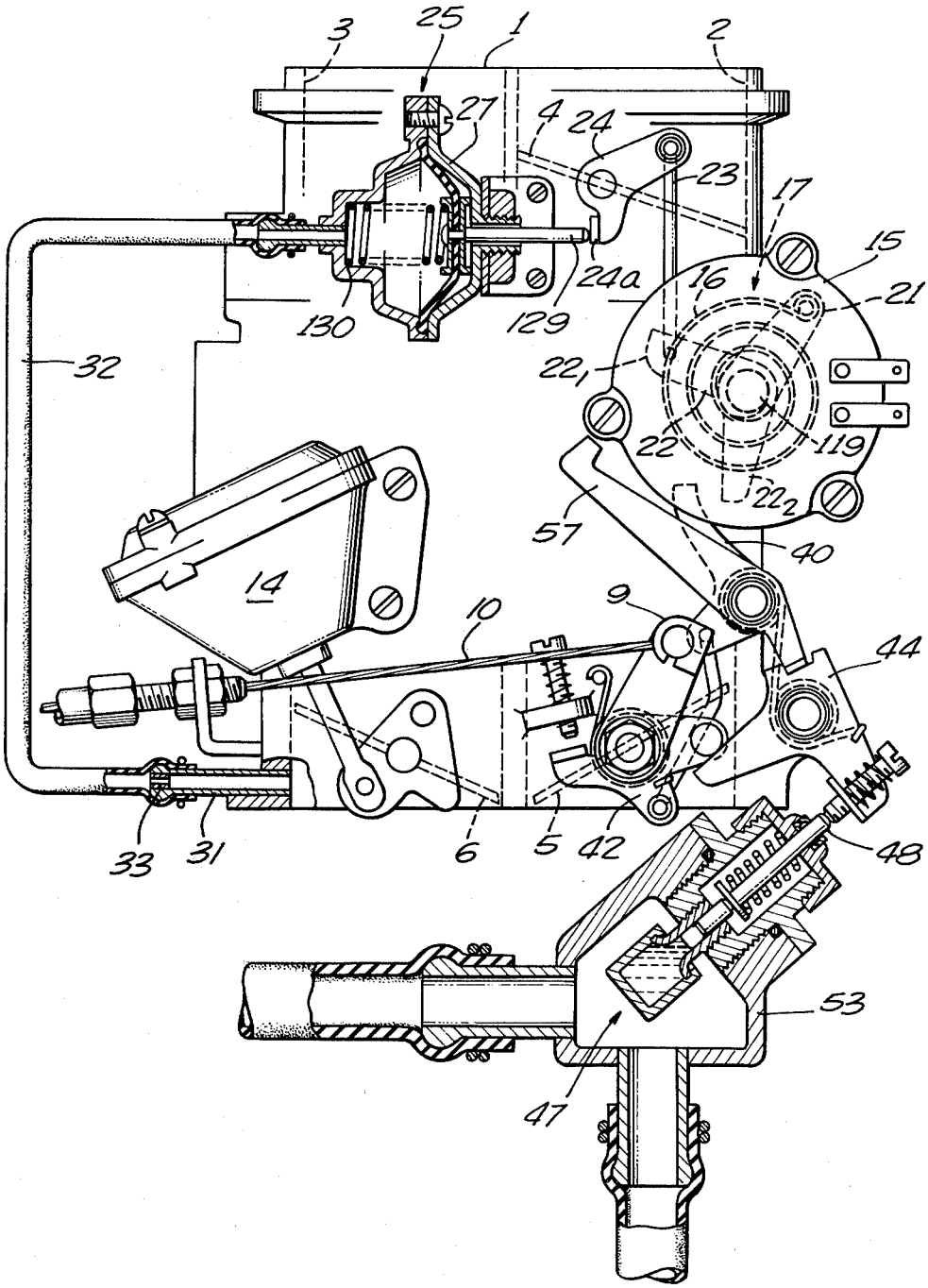
FIG. 4 is a front elevation partly in section showing a modified form of the invention.
Figure 5:
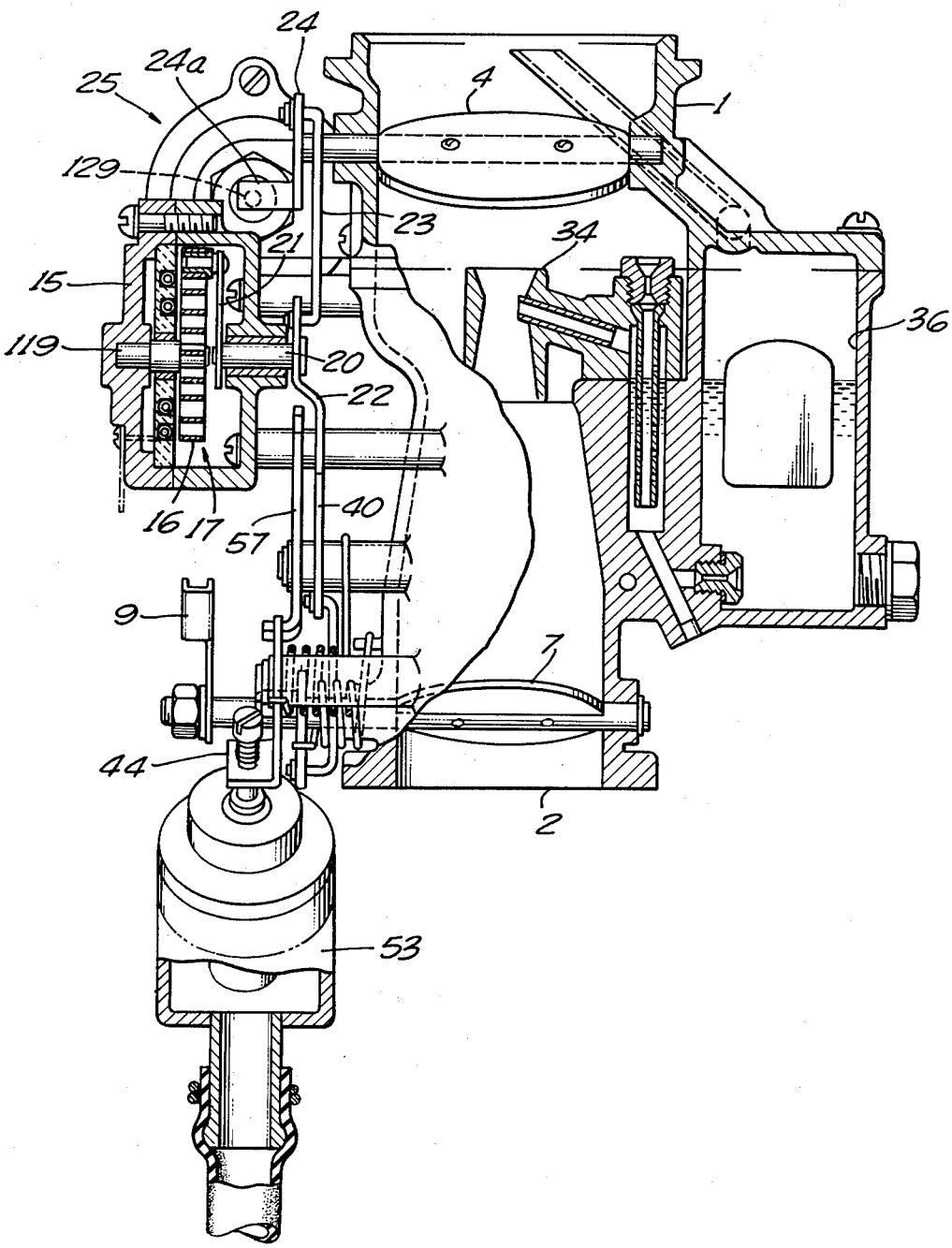
FIG. 5 is a side elevation partly broken away and partly in section, showing the device of FIG. 4.

In the modified form of the invention shown in FIGS. 4 and 5, the first sensor 17 is fixed in the first control case 15 by securing the inner end of the bimetal element 16 to the fixed shaft 119. The contact arm 24*a* is formed integrally with the choke lever 24 and is contacted by the tip of the operating rod 129 of the vacuum actuator 25, so that when the engine is not running the force of the valve closing spring 130 acts directly on the choke valve 4 as a choke valve closing torque as the force of the bimetal element 16. In other respects this form of the invention is similar to that previously described.

In accordance with this invention, the closing torque actually applied to the choke valve 4 is that torque which is equal to the difference obtained by subtracting from the closing torque produced by the valve closing spring 130 the opposing torque of the bimetal element 16 generated as a result of closing of the choke valve 4 by the closing torque. Since the bimetal element 16 has thermal deformation characteristics (as shown by the line A in FIG. 6) in proportion to lowering of the engine ambient temperature, the opposing torque of the bimetal element 16 at the time of closing of the choke valve 4 decreases, so that the actual choke valve closing torque increases. This action is shown by the choke valve closing torque line B' in FIG. 6. After complete firing of the engine, the vacuum actuator 25 moves the operating rod 129 against the force of the valve closing spring 130 to place the choke valve 4 under the sole control of the bimetal element 16, as that the choke pulldown angle moves to the angle shown in line A in FIG. 6.

From the foregoing description, it will be understood that this invention makes it possible, for starting the engine when it is cold, to provide the choke valve with closing torque suited to the engine ambient temperature, and after complete firing of the engine has begun to open the choke valve at the choke pulldown angle best suited to the engine ambient temperature. The tilting of the choke valve is increased without delay with rise in temperature, and the choke valve is held at a fully opened position under the action of the choke valve holding system when the engine is hot, so that despite changes in the engine ambient temperature, it is possible to supply the engine at all times with a proper air-fuel mixture, not only to improve startability of the engine but also to stabilize the warming operation to reduce the amount of unburned components in the exhaust gas. Furthermore, the construction is simplified because the driving source for the choke holding system can be employed as the second temperature sensitive means, which also is a driving source for the fast idling system for automatically adjusting tilting of the throttle valve for idling, dependent upon the engine temperature.

Having fully described our invention, it is to be understood that we are not to be limited to the details herein set forth but that our invention is of the full scope of the appended claims.

We claim:

1. A controlling device for a carburetor choke valve for an internal combustion engine, comprising in combination: a choke valve, a bimetal element sensing the engine ambient temperature, electrical resistance means for heating said bimetal element when said engine is in operation, the bimetal element having one end connected to operate the choke valve, means connected with the other end of the bimetal element for holding said other end at a first position when the engine is in the state of complete firing, and at a second position when the engine is stationary, said bimetal element acting to move said choke valve to choke pulldown angle in proportion to the engine ambient temperature and then opening it from said choke valve pulldown angle in response to the rise in the engine ambient temperature when said other end of the bimetal element is held at said first position.

2. A controlling device for a carburetor choke valve for an internal combustion engine, comprising in combination: a choke valve, a bimetal element sensing the engine ambient temperature, electrical resistance means for heating said bimetal element when said engine is in operation, means connecting one end of the bimetal element to the choke valve, means holding the other end of the bimetal element stationary, said choke valve having a choke lever, an operating rod, spring means normally urging said operating rod to engage said choke lever to move said choke valve in a closing direction under an approximately constant force when the engine is not running, means responsive only to manifold pressure for disengaging said operating rod from said choke lever to remove said force when the engine is in the state of complete firing, thereafter said bimetal element being the sole influence acting to move said choke valve to a choke pulldown angle in proportion to the engine ambient temperature then opening it from said choke pulldown angle in response to the rise in the engine ambient temperature, said disengaging means being in restricted communication with manifold pressure to delay disengagement during start up and to insure continued removal of said force when the engine is running.

* * * * *